United States Patent [19]

Force

[11] Patent Number: 4,771,690

[45] Date of Patent: Sep. 20, 1988

[54] SCREEN PRINTING APPARATUS FOR LIMITED FLEXIBILITY STOCK

[75] Inventor: George H. Force, Huntington Beach, Calif.

[73] Assignee: Ernst W. Dorn Company, Inc., Gardena, Calif.

[21] Appl. No.: 42,319

[22] Filed: Apr. 24, 1987

[51] Int. Cl.[4] ..... B41F 15/08; B65H 9/06; B65H 5/16

[52] U.S. Cl. ..... 101/124; 101/242; 271/245; 271/269

[58] Field of Search ..... 101/126, 124, 118, 117, 101/242, 241, 239; 271/269, 271, 42, 84, 245

[56] References Cited

U.S. PATENT DOCUMENTS

| | | | |
|---|---|---|---|
| 2,499,068 | 2/1950 | Jones | 271/269 |
| 2,606,492 | 8/1952 | Black | 101/124 |
| 2,893,543 | 7/1959 | Ervin | 271/269 X |
| 3,081,698 | 3/1963 | Childress et al. . | |
| 3,306,197 | 2/1967 | Jensen et al. . | |
| 3,318,236 | 5/1967 | Mueller . | |
| 3,369,807 | 2/1968 | Whelan, Jr. | 271/269 |
| 3,538,846 | 11/1970 | Jaffa . | |
| 3,542,359 | 11/1970 | Pilitz | 271/269 |
| 3,675,571 | 7/1972 | Vertegaal . | |
| 3,774,534 | 11/1973 | Ichinose . | |
| 3,889,595 | 6/1975 | Jaffa . | |
| 3,921,519 | 11/1975 | Zimmer . | |
| 3,952,651 | 4/1976 | Bolza-Schunemann | 101/242 |
| 3,998,156 | 12/1976 | Zimmer . | |
| 4,176,601 | 12/1979 | Szarka . | |
| 4,448,124 | 5/1984 | Nagatani . | |
| 4,509,422 | 4/1985 | Nagatani . | |

FOREIGN PATENT DOCUMENTS

| | | | |
|---|---|---|---|
| 47413 | 3/1982 | European Pat. Off. | 101/242 |
| 520271 | 9/1976 | U.S.S.R. | 101/242 |

*Primary Examiner*—Clifford D. Crowder
*Attorney, Agent, or Firm*—Leonard Tachner

[57] ABSTRACT

An improved cylinder-type screen printing apparatus utilizes recessible pushers and stops to translate sheet stock along the supply bed to the cylinder without imparting any substantial bending moment to the sheet stock. The absence of bending forces permits the apparatus to be used for printing on rigid materials.

3 Claims, 4 Drawing Sheets

SCREEN PRINTING APPARATUS FOR LIMITED FLEXIBILITY STOCK

BACKGROUND OF THE INVENTION

1. FIELD OF THE INVENTION

This invention relates to screen printing machines of the cylinder-type and particularly, to a screen printing machine that operates effectively with relatively stiff sheet material.

2. PRIOR ART

Screen printing machines of the cylinder-type have become increasingly popular for the reason that they are capable of high speed operation and precise registration for high quality color printing. In a typical prior art screen printing machine of the cylinder-type, a screen frame is horizontally mounted upon a reciprocating transport mechanism located above a cylinder. The cylinder functions as a printing platen.

The transport mechanism and the cylinder move in synchronism while a sheet of the stock material passes between the cylinder and that part of the screen engaged by a squeegee. In order to feed the sheet stock material to the print station, it is first advanced along an inclined bed until its leading edge contacts releasable stops. The cylinder then reverses and returns to its start position as grippers mounted on the cylinder close on the stock material. The transport mechanism and cylinder start movement in synchronism after the stops are operatively retracted. After an initial movement, the grippers release, allowing the sheet material to fall along a downwardly inclined receiving bed. The cylinder continues to move in synchronism with the transport mechanism. The remainder of the sheet material feed through. The cylinder reverses at the start of the next cycle to pick up the next sheet of material and the cycle of operation repeats.

If the stock material is relatively rigid, it resists the imposition of curvature. Thus the consequent stress due to bending reduces both the refinement and registry required for quality printing. Because of this resistance to curvature and the possible damage to rigid stock materials that may very well result, conventional cylinder-type screen printing machines are unsuitable. Consequently, rigid stock materials have had to be processed by hand one at a time in planar screen printing structures which are cumbersome and time-consuming to operate. The most relevant prior art known to the applicant includes the following:

U.S. Pat. No. 3,081,698: Childress et al.
U.S. Pat. No. 3,306,197: Jensen et al.
U.S. Pat. No. 3,318,236: Mueller
U.S. Pat. No. 3,538,846: Jaffa et al.
U.S. Pat. No. 3,675,571: Vertegaal
U.S. Pat. No. 3,774,537: Ichinose
U.S. Pat. No. 3,889,595: Jaffa
U.S. Pat. No. 3,921,519: Zimmer
U.S. Pat. No. 3,998,156: Zimmer
U.S. Pat. No. 4,176,601: Szarka
U.S. Pat. No. 4,448,124: Nagatani
U.S. Pat. No. 4,509,422: Nagatani U.S. Pat. No. 3,538,846 to Jaffa et al is particularly directed to a sheet ejector system for printing machines, and provides a conveyor mounted to a table base in adjacently extending relation to a table. There are a multiplicity of parallel spaced apart endless belts which pass over an idler roller positioned remote from the table. Switching and sequencing logic circuitry is provided and a carriage is raised with suction grippers positioned toward the table to grip a sheet mounted thereon. When the carriage is in the raised position, suction grippers are moved between the belts and away from the table in order to drag or pull the sheet onto the belts.

U.S. Pat. No. 3,318,236 to Mueller is directed to an electrostatic drum printer, relating to a limited flexibility stock for printing. In this reference, sheets are formed of plywood and a shaft is spaced above a horizontally extending row of rollers of a roller conveyor. The rollers are generally parallel with the shaft and are rotatively supported at their ends by the bearings on frame members.

U.S. Pat. No. 3,921,519 to Zimmer is directed to a rotary printing machine which includes a plurality of rotating printing cylinders. A web of material is supported on a printer's blanket which is moved and guided over guide rollers.

U.S. Pat. No. 3,889,595 to Jaffa is directed to a continuous rotary screen printing system and provides for a frame assembly which has a pair of end rollers journalled adjacent the end portions of a frame assembly. An endless belt/printing blanket passes over the end rollers. An upper flight of the endless belt provides for a movable printing bed for supporting the material to be printed.

U.S. Pat. No. 4,176,601 to Szarka is directed to what is termed an automated towel transfer printing-/feeding/drying/folding apparatus. They provide a conveyor system having an endless printing belt for supporting and indexing a workpiece during the screen printing operation. They include a transfer apparatus which is located adjacent the discharge end of the indexing printing belt and such includes a removing system in the form of belt strips having gripping pins to peel and remove the workpiece from the printing belt.

SUMMARY OF THE INVENTION

In order to accomplish this objective, I provide supply and receiving beds for the stock material that closely approach parallelism with the screen transport mechanism whereby the imposed curvature is minimized. More importantly, I provide a design which eliminates the cylinder grippers of the prior art as well as all other prior art members that would otherwise tend to impart a bending moment to the stock material. For example, in my invention, the sheet is never pressed down in transit except by the squeegee and screen onto the cylinder along a single line. My invention uses recessible pushers and stops to control the sheet for feeding it toward the cylinder. The cylinder is used solely as a platen; the sheet material is moved into position against stops and then pushed through the point of tangency with the screen, its path immediately departing from the periphery of they cylinder.

This invention possesses many other advantages, and has other objects which may be made more clearly apparent from a consideration of the embodiment of the invention shown and described.

OBJECTS OF THE INVENTION

The primary object of the present invention is to provide a screen printing machine of the cylinder-type that operates effectively with relatively rigid stock material, by substantially eliminating any tendency for the stock material to be bent.

Another object of the present invention is to provide a screen printing machine of the cylinder-type which utilizes pushers to avoid any bending of the print stock material on the supply bed of the machine.

Still another object of the present invention is to provide a cylinder-type screen printing machine which avoids the use of bending moments to handle a relatively rigid stock material and which feeds the material to the cylinder along a supply bed which is virtually in the plane of tangency to the cylinder.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the accompanying drawings in which.

DETAILED DESCRIPTION OF A PREFERRED EMBODIMENT

The following detailed description is of the best presently contemplated mode of carrying out the invention. This description is not to be taken in a limiting sense, but is made merely for purposes of illustrating the general principles of the invention, the scope of the invention being defined by the appended claims.

Figure 1:
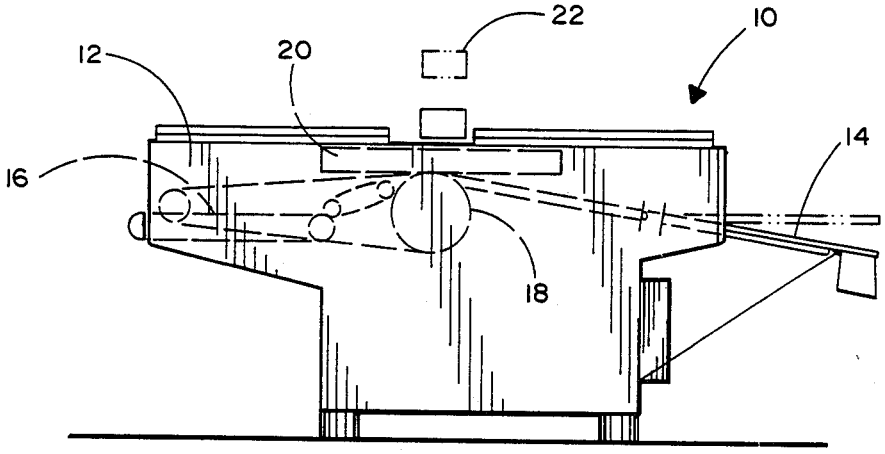
FIGS. 1 and 2 are side and top schematic representations, respectively, of the screen printing apparatus of the invention illustrating the general path of the printing sheets therein.
Figure 2:
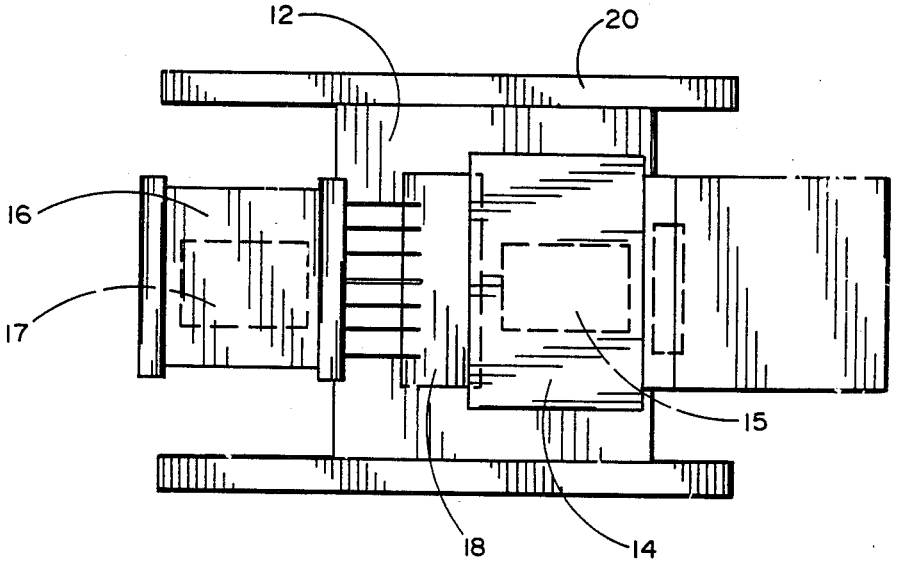

Referring initially to FIGS. 1 and 2, it will be seen that the screen printer 10 of the present invention comprises a housing 12 having a supply bed 14 for feeding in unprinted stock sheets 15 and a receiving bed 16 for receiving printed stock sheets 17. Most of the design of the screen printer 10 is of a conventional nature and therefore need not be described herein in great detail. By way of example, the invention utilizes a cylinder 18 which acts as a rotating printing platen; a movable screen frame 20 which synchronously translates a print screen horizontally over the cylinder in unison with the sheet stock; and a squeegee 22 which synchronously translates vertically above the cylinder to apply an appropriate printing medium through the screen and onto the sheet stock.

Figure 3:
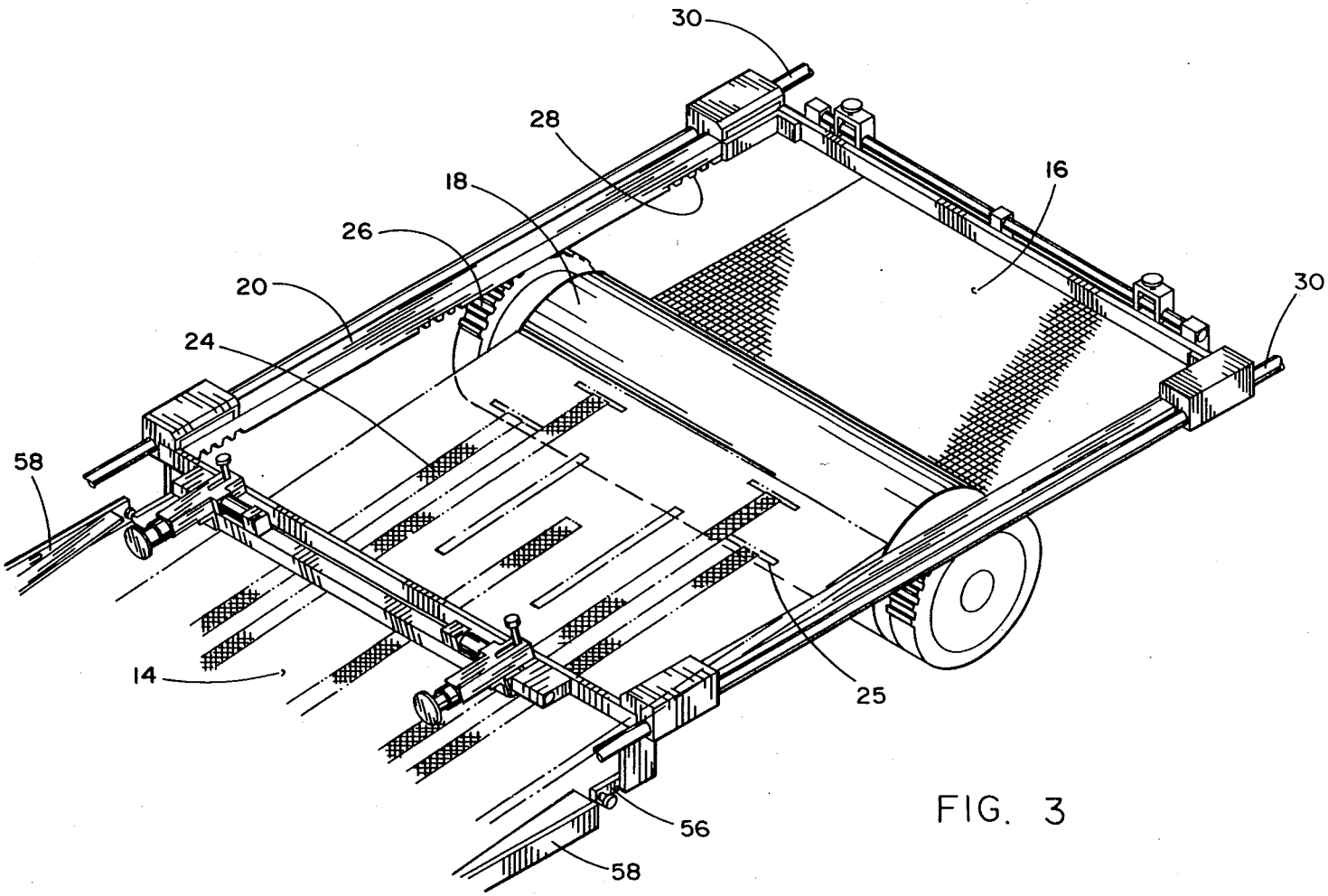
FIG. 3 is an isometric representation of the supply or feed bed of the invention.
Figure 4:
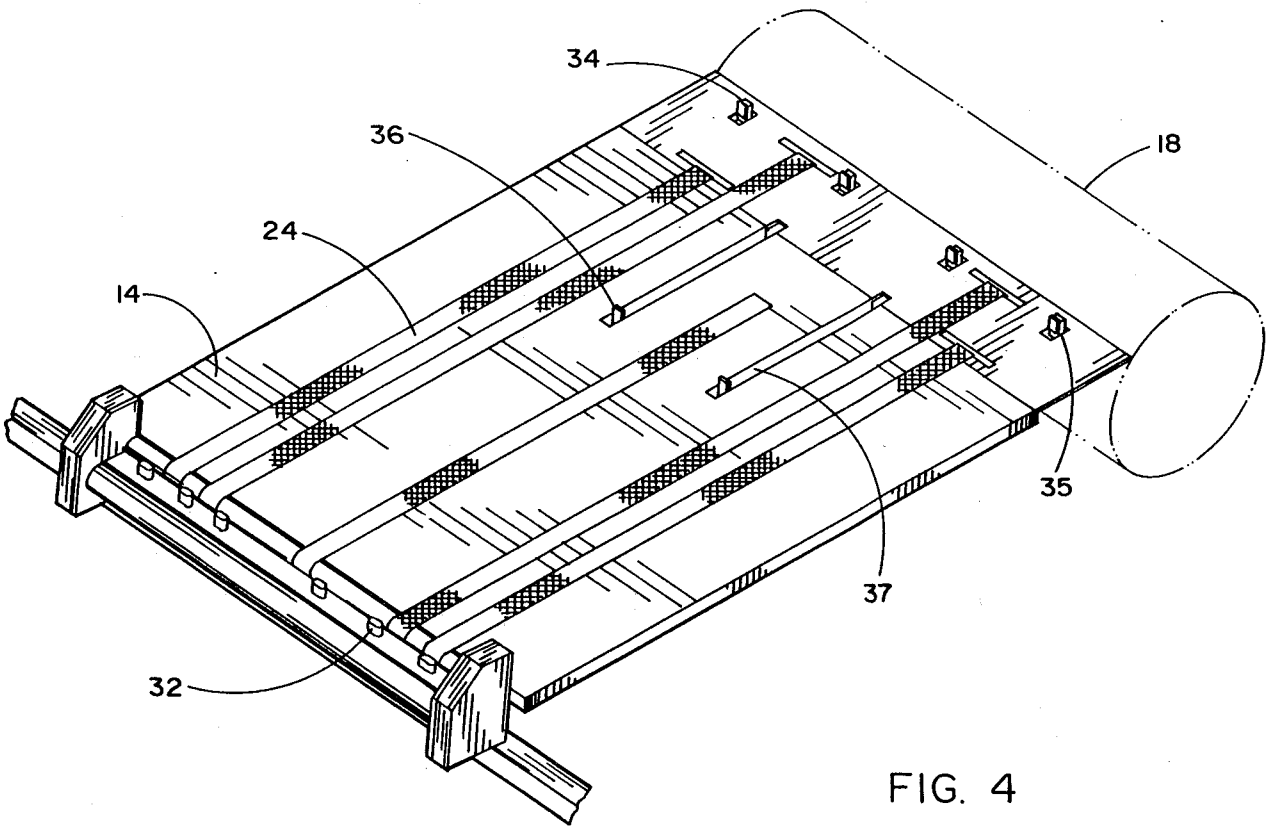
FIG. 4 is an isometric view of the supply bed shown with the screen frame removed.
Figure 5:
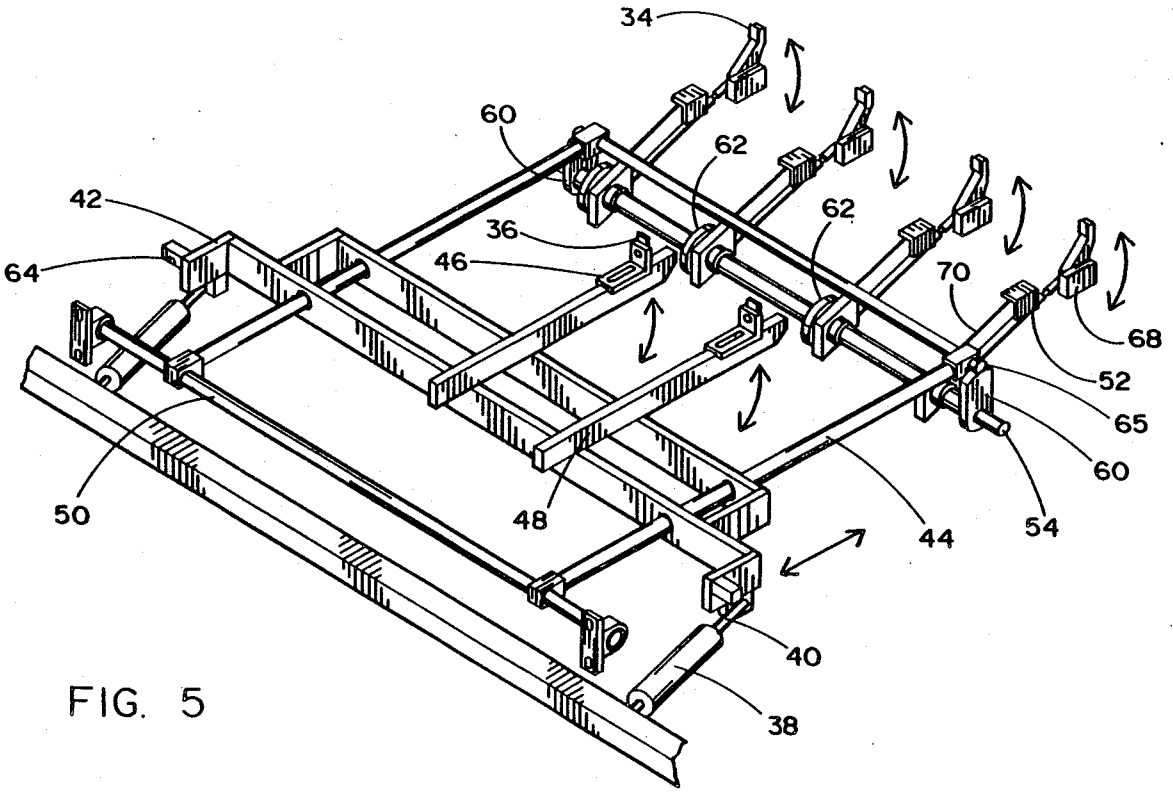
FIG. 5 is an isometric view of the pusher and stop mechanism of the supply bed of the invention.

Referring now to FIGS. 3–5 it will be seen that the supply bed 14 is provided with a plurality of circuitous feed belts 24 which are positioned along the upper surface of the supply bed and pass through apertures 25 to form a continuous moving loop for urging the sheet stock 15 toward the cylinder 18. It will also be seen that the cylinder and screen frame 20 are mechanically locked in synchronism by meshed cylinder teeth 26 and frame teeth 28 whereby as the cylinder rotates, the screen frame translates linearly along a pair of frame rails 30.

Supply bed 14 is also provided with a plurality of first stops 32 (see FIG. 4) which initially holds the sheet stock 15 until the proper instant for entry onto the supply bed to synchronize the sheet stock with the screen frame and the cylinder during each printing cycle. When that instant occurs overhead friction rollers (not shown) descend onto the stock and feed it onto the feed belts 24. The stock travels toward the cylinder 18 until stopped by a plurality of second stops 34 which extend above the surface of supply bed 14 through apertures 35. During this time, the stock is adjusted in appropriate side registration in a conventional manner.

During this traversal of the supply bed, the stock passes over a plurality of recessed pushers 36 below the bed surface within elongated channels 37. When the stock has been momentarily stopped by second stops 34, the tail end of the sheet is forward of the pushers so that they can be then raised above the bed surface through the channels without interfering with the sheet stock before its forward end reaches the second stops.

When the screen frame 20 is at its rear-most position (i.e., farthest from the cylinder) and reverses direction with cylinder 18, second stops 34 are recessed into apertures 35. Pushers 36, initially behind the rear edge of the sheet stock, being traversing toward the cylinder in synchronism with the cylinder and screen frame. This synchronism is achieved by engagement of a pair of latches 56 (FIG. 3) with a pair of latching lugs 64 (FIG. 5) thereby moving a pusher rack 42 in unison with screen frame 20 until at the end of the pusher stroke the latches 56 are disengaged from lugs 64 by a pair of cams 58 (FIG. 3). Within the elongated channels 37, (FIG. 4), pushers 36 push the stock sheet onto cylinder 18 until the frictional engagement between the cylinder and squeegee 22 effectively "grabs" the sheet stock and translates it toward and onto the receiving bed 16. At no time during this feed portion of each print cycle is the stock subjected to any bending forces. Consequently, unlike cylinder-type screen printing machines of the prior art, the present invention is capable of printing on stiff sheet materials, such as thick or otherwise relatively inflexible materials, without bending and thus damaging such materials.

The aforementioned, highly advantageous feature of the present invention is, in the presently preferred embodiment thereof, provided by the mechanical design aspects illustrated best in FIG. 5. More specifically, as seen in FIG. 5, the invention further comprises a pair of pneumatic cylinders 38, a pusher rack 42, pusher brackets 46, a pair of pusher rails 48, pusher elevation cams 60, pivot shaft 50, stop actuator cams 62 and cam lugs 65. It will be understood that some of the conventional structural components of the pusher and stop control mechanism have been omitted to preclude obfuscation of the basic implementation. However, all such structural components are of a trivial nature and well within the routine mechanical knowledge of those having ordinary skill in the art to which the present invention pertains.

It will be apparent that the pushers 36 may be adjusted for different length sheet stock by means of brackets 46 which may be readily slid along rails 48 to provide the required starting and stopping points. Rails 48 are secured to the push rack assembly 42. When pneumatic cylinders 38 are actuated, their respective push rods 40 cause rack 42 to travel along rails 44 to return to the starting position. Rotation of cam shaft 54 causes engagement of cams 60 and cam lugs 65 to elevate pushers 36 at the correct time to push sheet 15 as latches 56 engage lugs 64 on rack 42 and move the assembly toward cylinder 18. Cam shaft 54 also recesses pushers 36 for return to their starting position by air cylinders 38. Thus, cylinders 38 provide the means for controlling the return of pushers 36 to their starting position.

Second stops 34 are moved only in elevation during the return cycle and this motion is controlled by actuator cams 62 which cause limited angle rotation of the stops relative to a pivot blocks 68. Springs 70, attached to stops 34 by means of spring anchors 52, assure that stops 34 will be recessed whenever the pushers 36 are elevated.

It will not be understood that what has been disclosed herein comprises an improved cylinder-type screen printing apparatus which is uniquely capable of processing inflexible sheet stock by handling the stock without imparting any substantial bending moment in feeding it to the cylinder. A plurality of recessible stops and pushers control the position of the sheet stock without bending it or even encouraging it to bend, thus permitting the processing of substantially rigid materials while retaining the benefits of substantially automatic handling.

Those having skill in the art to which the present invention pertains, will now as a result of the applicant's teaching herein, perceive various modifications and additions which may be made to the invention. By way of example, other means for pushing and stopping the sheet stock without incurring a bending moment, will now become apparent. However, all such modifications and additions are deemed to be within the scope of the invention which is to be limited only by the claims appended hereto.

I claim:

1. An improved cylinder-type screen printing apparatus, the apparatus of the type having a rotatable printing cylinder, a supply bed for feeding sheet stock to the cylinder, a receiving bed for receiving the sheet stock after printing, a screen frame for translating a printing screen linearly over the cylinder in synchronism with the sheet stock, and a squeegee positioned above the cylinder for applying a print medium to the sheet stock through the printing screen; the improvement comprising:

a supply bed having at least one pusher for contacting an edge of said sheet stock and pushing against said edge to translate said sheet stock onto said cylinder until said sheet stock is retained between said cylinder and said squeegee, said supply bed being substantially in the plane of a tangent to said cylinder whereby no substantial bending moment is applied to said sheet stock;

means for translating said sheet stock into position wherein said pusher contacts said edge, and at least one channel in the surface of said supply bed into which said pusher is recessed below the surface of said supply bed while said sheet stock is translated into said position; and means for controlling the vertical and horizontal position of said pusher;

wherein said pusher controlling means comprises at least one latch extending from said pusher transverse to the direction of its motion for temporarily engaging said screen frame during its forward motion, a pneumatic cylinder having one end affixed to said supply bed and an extendable rod affixed to said pusher for return of said pusher to its starting position, and a cam actuated rack for selectively raising and lowering said pusher relative to said supply bed.

2. The improvement recited in claim 1 wherein said pusher controlling means comprises means for varying the translation limits of said pusher for accommodating different lengths of sheet stock.

3. The improvement recited in claim 1 further comprising at least one recessible stop and an aperture in said supply bed through which said stop is selectively raised and recessed, whereby the translation of said sheet stock may be stopped temporarily for synchronizing the travel of said sheet stock with the rotation of said cylinder.

* * * * *